US007443353B2

(12) United States Patent
Fujimoto et al.

(10) Patent No.: US 7,443,353 B2
(45) Date of Patent: Oct. 28, 2008

(54) VEHICLE-MOUNTED ANTENNA

(75) Inventors: Hiroshi Fujimoto, Zama (JP); Yoshinosuke Mukou, Tokyo (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 30 days.

(21) Appl. No.: 11/389,155

(22) Filed: Mar. 27, 2006

(65) Prior Publication Data

US 2006/0214863 A1 Sep. 28, 2006

(30) Foreign Application Priority Data

Mar. 28, 2005 (JP) ..... 2005-090947

(51) Int. Cl.
*H01Q 1/32* (2006.01)

(52) U.S. Cl. ..... 343/713

(58) Field of Classification Search ..... 343/711–714, 343/702; 455/445, 436, 905
See application file for complete search history.

(56) References Cited

U.S. PATENT DOCUMENTS 6,104,815 A * 8/2000 Alcorn et al. ..... 380/251
6,271,798 B1 * 8/2001 Endo et al. ..... 343/713
6,766,172 B1 * 7/2004 Tokuda et al. ..... 455/445
2001/0033249 A1 * 10/2001 Endo et al. ..... 343/713
2004/0104855 A1 * 6/2004 Nomiyama et al. ..... 343/702
2004/0196179 A1 * 10/2004 Turnbull ..... 342/357.06
2005/0052334 A1 * 3/2005 Ogino et al. ..... 343/866
2006/0004486 A1 * 1/2006 Yoshikawa et al. ..... 700/245
2006/0220971 A1 * 10/2006 Sato et al. ..... 343/718

FOREIGN PATENT DOCUMENTS

JP 2002-187489 A 7/2002

* cited by examiner

*Primary Examiner*—Huedung Cao Mancuso
(74) *Attorney, Agent, or Firm*—Foley & Lardner LLP

(57) ABSTRACT

A vehicle-mounted antenna for a vehicle-mounted information processing device performs wireless communication within a vehicle between the vehicle-mounted information processing device located at a rear side of a veneer plate and another electronic circuit within the vehicle. The vehicle-mounted information processing device reads data from a medium inserted via a media insertion opening formed in the veneer plate and executes various processing based on the read-in data. The vehicle-mounted antenna is arranged deeper than the media insertion opening, within a region set if the media insertion opening is extended in a direction substantially orthogonal with the veneer plate.

12 Claims, 3 Drawing Sheets

VEHICLE-MOUNTED ANTENNA

BACKGROUND OF THE INVENTION

1. Field of the Invention

The present invention relates to a vehicle-mounted antenna.

2. Description of the Related Art

Car navigation systems where an information processing device mounted on a vehicle constitutes a wireless communication with other electronic circuitry within the vehicle such as, for example, a mobile telephone are known. In such car navigation systems, communication takes place via a base station outside of the vehicle via the mobile telephone. In a car navigation system disclosed in Japanese Patent Laid-open Publication No. 2002-187489, it is disclosed that a vehicle-mounted antenna is built into a hazard switch button in order for an information processing device mounted on a vehicle to carry out wireless communication with a mobile telephone within the vehicle.

SUMMARY OF THE INVENTION

In the aforementioned document, the vehicle-mounted antenna is built into the hazard switch button since the hazard switch button is provided at a position a short distance from the driver and facing the driver and does not shield the antenna with metal components. However, as the vehicle-mounted antenna is provided within the hazard switch button, it is necessary to take a cable for connecting the antenna from the information processing device mounted in the vehicle to within the hazard switch button. This requires a large number of parts and is expensive, as well as being time-consuming at the time of assembly.

A vehicle-mounted antenna for a vehicle-mounted information processing device according to the present invention performs wireless communication within a vehicle between the vehicle-mounted information processing device located at a rear side of a veneer plate and another electronic circuit within the vehicle, with the vehicle-mounted information processing device reading data from a medium inserted via a media insertion opening formed in the veneer plate and executing various processing based on the read-in data. The vehicle-mounted antenna is arranged deeper than the media insertion opening, within a region set if the media insertion opening is extended in a direction substantially orthogonal with the veneer plate.

DESCRIPTION OF THE PREFERRED EMBODIMENT

1. Overall Configuration (FIG. 1)

Figure 1:
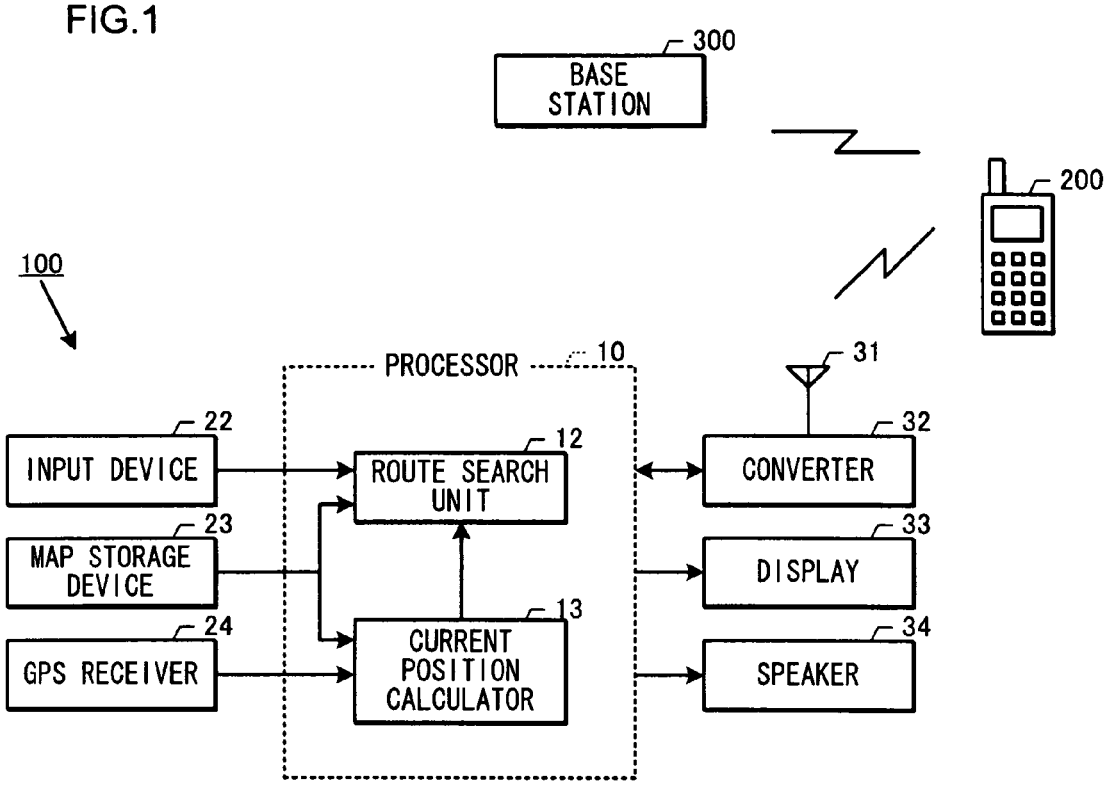
FIG. 1 is a block view showing an example configuration of vehicle-mounted equipment to which a vehicle-mounted antenna of the present invention is connected and other electronic circuitry within a vehicle constituting a wireless LAN with the vehicle-mounted equipment.

FIG. 1 is a block view showing an example configuration of vehicle-mounted equipment to which the vehicle-mounted antenna of the present invention is connected and other electronic circuitry within the vehicle constituting a wireless LAN with the vehicle mounted equipment. This electronic equipment and electronic circuitry constitutes a car navigation system. The vehicle-mounted equipment 100 is an information processing device where an input device 22, a map data storage device 23, a GPS receiver 24, an antenna 31, a converter 32, a display 33 and a speaker 34 are connected to a processor 10. A mobile telephone 200 is shown here as an electronic circuit.

The input device 22 is, for example, constituted by operation buttons provided at, for example, the vehicle-mounted equipment 100 or a touch panel on a display 33 that receives input operations performed by a user and transmits an input signal to the processor 10. The map data storage device 23 is configured from a non-volatile storage device such as, for example, a DVD ROM or Hard Disc Drive etc. and is for storing road map data. Data stored in the map data storage device 23 is capable of being read by the processor 10. The GPS receiver 24 receives synchronizing radio signals from a plurality of GPS satellites (not shown) and transmits time difference information for the time up to receipt of radio signals from each GPS satellite to the processor 10.

The antenna 31 is equipped with a radio signal transceiver function for carrying out communication between the vehicle-mounted equipment 100 and the mobile telephone 200. High-frequency wireless communication such as Bluetooth (registered trademark) etc. is preferable for communication between the vehicle-mounted equipment 100 and the mobile telephone 200. The converter 32 includes an AD/DA converter and a communication circuit and carries out communication with the mobile telephone 200 via the antenna 31. Dial instructions for the mobile telephone 200 are included in data sent from the processor 10 to the antenna 31 via the converter 32.

The display 33 outputs image data generated by the processor 10 and displays images such as for the current position of the vehicle, a map of the vehicle surroundings, and the route to the destination and traffic congestion information etc. The display 33 is, for example, constituted of a liquid crystal monitor. A speaker 34 outputs audio data generated at the processor 10, and outputs guidance announcements such as instructions to turn right or left before an intersection or traffic congestion information, etc.

The processor 10 is equipped with a route search unit 12 and a current position calculator 13, etc. The current position calculator 13 calculates the current position based on time difference information received from the GPS receiver 24 and map data read from the map data storage device 23. The route search unit 12 searches for a route to the destination based on various information such as traffic congestion information received from the antenna 31 via the converter 32, current position information calculated by the current position calculator 13, destination information inputted by the input device 22, and map data read from the map data storage device 23.

The mobile telephone 200 is a mobile telephone in the possession of the user and is located in a clothes pocket of the user (for example, the driver), in a telephone holder near a driver's seat, or on a passenger seat, etc. When a dial instruction is received from the processor 10 of the vehicle-mounted equipment 100 via the converter 32 and the antenna 31, the mobile telephone 200 automatically dials a base station 300 so as to receive various information such as traffic congestion information etc. The various information received from the base station 300 is then transmitted to processor 10 of the vehicle-mounted equipment 100.

As described above, the vehicle-mounted equipment 100 and the mobile telephone 200 constitutes a car navigation system.

2. First Embodiment (FIG. 2, FIG. 3)

2-1. Configuration of First Embodiment

Figure 2:
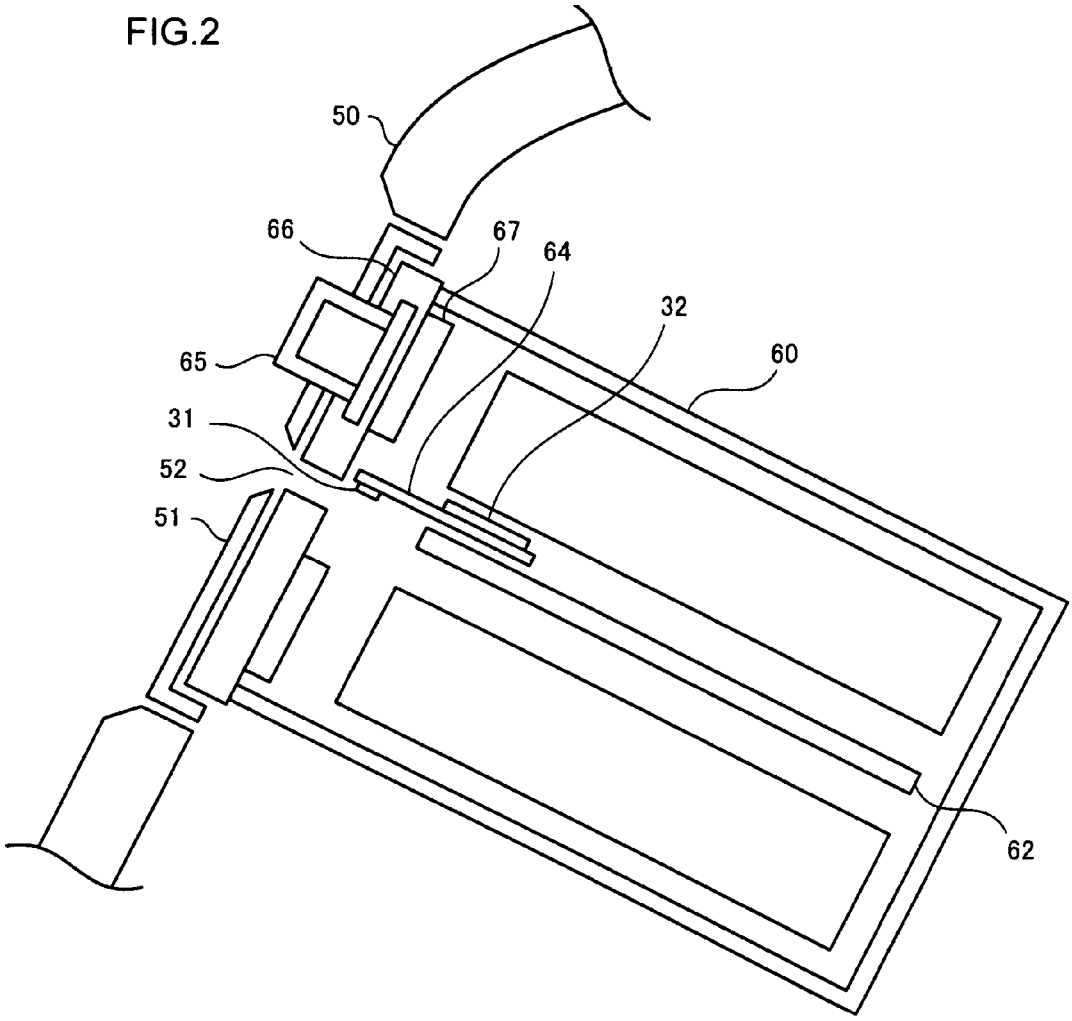
FIG. 2 is a cross-sectional view showing an arrangement for a vehicle-mounted antenna of a first embodiment of the present invention.
Figure 3:
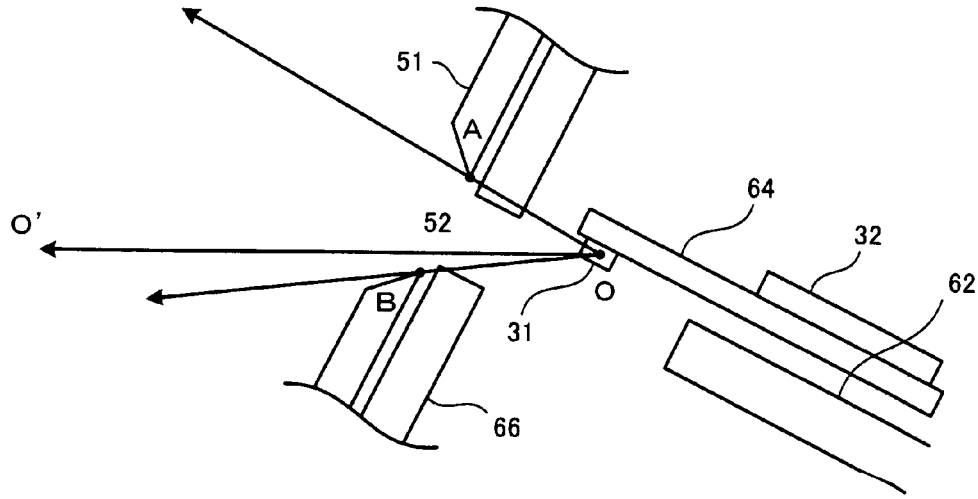
FIG. 3 is a partially enlarged view of FIG. 2.

FIG. 2 is a cross-sectional view showing an arrangement for a vehicle-mounted antenna of a first embodiment of the present invention. FIG. 3 is a partially enlarged view of FIG. 2. Here, an audio/navigation unit 60 with a front surface covered by a resin panel 66 is incorporated at the back of a metal panel 51 constituting part of a vehicle equipment panel (instrument panel) 50. Of the vehicle equipment 100, the AD/D/A converter and communication circuit constituting the converter 32, and the antenna 31 are equipped within the audio/navigation unit 60.

The metal panel 51 is adopted with the purpose of providing a luxurious design. A slit-shaped media insertion opening 52 for inserting a medium (information recording medium) 62 such as CDs and DVDs etc. is provided in the metal panel 51. The media insertion opening 52 may also be configured to be compatible with information recording media different to CDs and DVDs such as, for example, MDs. The medium 62 can be inserted into the audio/navigation unit 60 through the media insertion opening 52. The position of the medium 62 shown in FIG. 2 and FIG. 3 is taken as a media reading position of the first embodiment.

In addition to a metal plate, the metal panel 51 may also be constituted of a veneer plate including a metal layer or metal-containing layer. When the metal panel 51 is constituted of a metal plate, or a veneer plate composed of a plate including a metal layer or a metal-containing layer, electromagnetic radiation is blocked by the metal panel 51.

An operation switch 65 corresponds to input device 10 shown in FIG. 1 and is operated by a user in order to give operation instructions to the audio/navigation unit 60. The operation switch 65 may be composed of material, for example, a resin, that allows electromagnetic waves to pass, and a resin panel 66 is also transparent to electromagnetic waves. An audio operation substrate 67 that is not transparent to electromagnetic waves is provided at the back of the resin panel 66. If wireless communication is to be carried out with the mobile telephone 200 through an electromagnetic wave transmitting section or resin part of the operation switch 65, it is necessary to provide a cable to the operation switch 65 as far as the antenna beyond the audio operation substrate 67. Further, in the event that the operation switch 65 is not transparent to electromagnetic waves, reconsideration of the location of the antenna is necessary.

The antenna 31 of this embodiment is mounted on a substrate 64 at an end part close to the media insertion opening 52 within the audio/navigation unit 60. The substrate 64 is a communication circuit substrate of the audio/navigation unit 60. The antenna 31 is positioned back from the media insertion opening 52 so as to face the vehicle interior via the media insertion opening 52. Namely, the antenna 31 is positioned looking the vehicle interior through the media insertion opening 52, i.e. arranged with in a region of the media insertion opening set if the media insertion opening 52 is extended or projected in a direction substantially orthogonal to the metal panel 51. Further, the antenna 31 is mounted on the communication circuit substrate 64. There is therefore no cable used for the antenna 31 in this configuration and use of a cable connector is also not necessary.

In FIG. 3, a direction in which the antenna 31 faces the vehicle interior through the media insertion opening 52 is shown. An antenna radiation angle AOB in a direction facing the vehicle interior from the antenna (point 0) via the media insertion opening 52 is decided by an upper end (point A) and a lower end (point B) of the media insertion opening 52. The antenna radiation angle AOB is set so as to ensure good communication with the mobile telephone 200 located in a clothes pocket of the user (for example, a driver), a telephone holder at the periphery of the driver's seat, or located on the passenger seat, etc. The antenna 31 is preferably provided on the upper side from a media insertion path from the media insertion opening 52 to the reading position of the medium 62. In particular, by arranging the antenna 31 in this manner, when the audio/navigation unit 60 is incorporated in the equipment panel 50 inclined in the manner shown in FIG. 2 and FIG. 3, a radiation angle AOO' upwards from the horizontal line O-O' and a radiation angle O'OB downwards can reliably be ensured. Further, it is particularly preferable for the antenna 31 to be arranged in the vicinity of the media insertion opening 52.

Further, in the first embodiment, the media reading position or the insertion completion position of the medium 62 set, for example, through the automatic loading function for the medium 62 performed by the audio/navigation unit 60 is sufficiently deep so as to be away from the media insertion opening 52. The antenna 31 is positioned further to the side of the media insertion opening 52 than the end of the medium 62 on the side of the media insertion opening 52 when the medium 62 is inserted as far as the media reading position. This means that the antenna 31 is in a position where the antenna radiation angle AOB facing the vehicle interior through the media insertion opening 52 is not blocked out by the end of the medium 62 when the medium 62 is inserted as far as the media reading position.

2-2. Operational Effects of First Embodiment (1) According to the embodiment described above, the antenna 31 is provided more deeply than the media insertion opening 52 provided at the vehicle, at a position facing the vehicle interior via the media insertion opening 52. It is therefore possible to carry out superior wireless communication within the vehicle with the mobile telephone 200. It is also not necessary to run a cable from the vehicle-mounted equipment 100 as far as the operation switch 65, a hazard switch button and or the like in order to connect the antenna 31. This means that the number of components can be reduced. Moreover, the media insertion opening 52 is provided in a large number of vehicles. This means that antenna arrangement is straightforward and does not depend on differences in the model design of the audio/navigation unit 60.

(2) In the first embodiment, the antenna 31 is mounted on the substrate 64 of the audio/navigation switch 60. It is therefore not necessary to use an antenna extension cable etc., and a simple configuration can be achieved.

(3) In the first embodiment, the antenna 31 is provided on the upper side from a media insertion path from the media insertion opening 52 to the media reading position. In this way, it is possible to maintain superior communication with the mobile telephone 200.

(4) In the first embodiment, the antenna 31 is positioned further to the side of the media insertion opening 52 than the end of the medium 62 on the side of the media insertion opening 52 when the medium 62 is inserted as far as the media reading position. This means that the antenna 31 is in a position where the antenna radiation angle AOB facing the inside of the vehicle through the media insertion opening 52 is not blocked out by the end of the medium 62 when the medium 62 is inserted as far as the media reading position. In this way, recording layer portions of the medium 62 that are not transparent to electromagnetic waves do not block the antenna radiation direction and superior communication with the mobile telephone 200 can be maintained.

(5) Even if the periphery of the media insertion opening 52 is constructed from the metal panel 51 equipped with a metal plate, or a metal layer or metal-containing layer, causing electromagnetic waves to be blocked out as in the first embodiment, by adopting the arrangement described above for the antenna 31 facing the vehicle interior through the media insertion opening 52, it is possible to ensure good communication with the mobile telephone 200 while providing a luxurious design.

(6) In the first embodiment, high-frequency wireless communication is carried out between the vehicle-mounted equipment 100 and the mobile telephone 200. It is therefore possible to carry out high-speed, low power consumption wireless communication.

3. Second Embodiment (FIG. 4, FIG. 5)

3-1. Configuration of Second Embodiment

Figure 4:
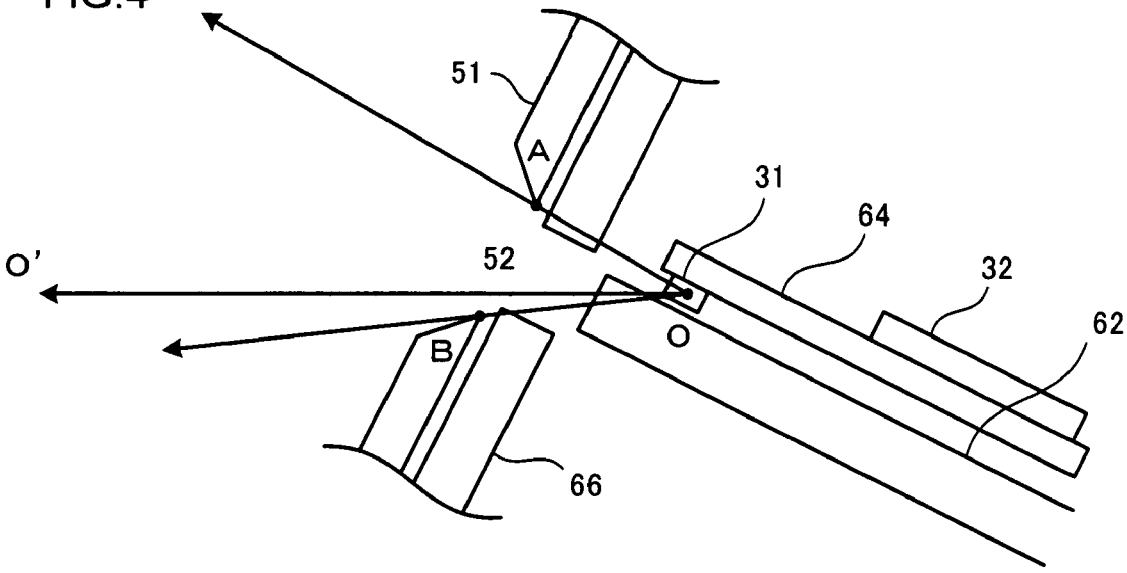
FIG. 4 is an enlarged cross-sectional view showing an arrangement for a vehicle-mounted antenna of a second embodiment of the present invention.
Figure 5:
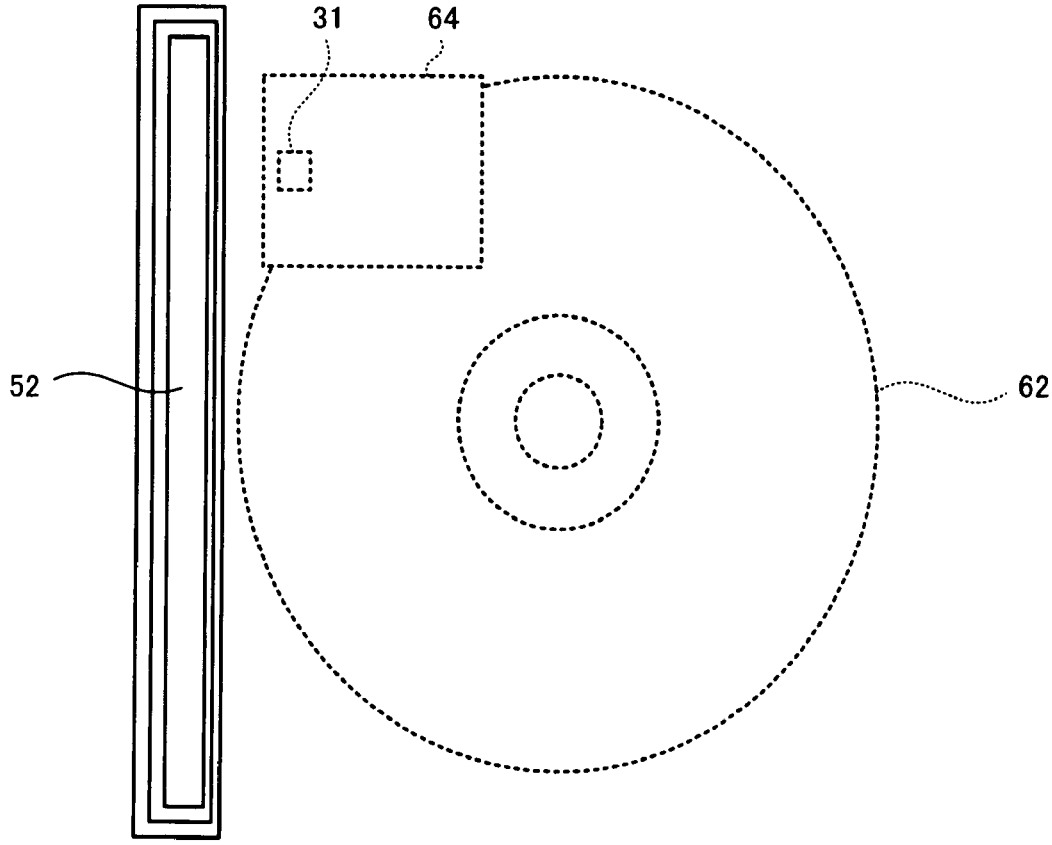
FIG. 5 is a plan view showing an arrangement for the vehicle-mounted antenna of the second embodiment of the present invention.

FIG. 4 is an enlarged cross-sectional view showing an arrangement for a vehicle-mounted antenna of a second embodiment of the present invention. FIG. 5 is a plan view showing an arrangement for this vehicle-mounted antenna. Portions that are the same as for the first embodiment are given the same numerals and are not described in detail.

The media reading position of the medium 62 in the second embodiment is different to that of the first embodiment. In the second embodiment, the audio/navigation unit 60 is not provided with a function for automatically loading the medium 62 and the media reading position or the insertion completion position of the medium 62 is further to the side of the media insertion opening 52 than that of the first embodiment. The antenna 31 is positioned deeper than the end of the medium 62 on the side of the media insertion opening 52 when the medium 62 is inserted as far as the media reading position (refer to FIG. 4).

In the second embodiment, as shown in FIG. 5, the antenna 31 is at a position offset along a longitudinal direction of the slit-shaped media insertion opening 52 relative to the end of the medium 62 which is the closest to the media insertion opening 52. In particular, the antenna 31 and the medium 62 in the media reading position are arranged so as not to overlap in a plane. Therefore, in the second embodiment also, the antenna 31 is in a position where the antenna radiation angle AOB facing the vehicle interior through the media insertion opening 52 is not blocked out by the end of the medium 62 when the medium 62 is inserted as far as the media reading position.

In the cross-sectional view shown in FIG. 4, the antenna radiation angle AOB facing the vehicle interior via the media insertion opening 52 and the end of the medium 62 are shown as overlapping but in reality, as shown in FIG. 5, the antenna radiation angle and the end of the medium 62 do not overlap. Further, similarly for an antenna radiation angle along the longitudinal direction of the media insertion opening 52, the antenna 31 is arranged in such a manner as not to overlap with the end of the medium 62.

3-2. Operational Effects of Second Embodiment

According to the second embodiment described above, in addition to the same operational effects as for the first embodiment, the following operational effects can be achieved.

(1) In the second embodiment, the antenna 31 is at a position offset along the slit-shaped media insertion opening 52 from the end of the medium 62 located closest to the media insertion opening 52. This means that the antenna 31 is in a position where the antenna radiation angle AOB facing the vehicle interior via the media insertion opening 52 is not blocked out by the end of the medium 62 when the medium 62 is inserted as far as the media reading position. In this way, recording layer portions of the medium 62 that are not transparent to electromagnetic waves do not block the antenna radiation direction and superior communication with the mobile telephone 200 can be maintained.

The electronic circuit of the present invention is by no means limited to the mobile telephone 200, and may be any item communicating in a wireless manner within the vehicle with an information processing device mounted on the vehicle such as a small scale circuit such as an IC tag etc., PHS, PDA, or personal computer etc.

The present invention relates to a vehicle-mounted antenna for a vehicle-mounted information processing device, for performing wireless communication with in a vehicle between the vehicle-mounted information processing device located at a rear side of a veneer plate for reading data from media inserted via a media insertion opening formed in the veneer plate and executing various processing based on the read-in data and another electronic circuit within the vehicle, and may also be applied to cases where a veneer plate is made of material that does not block electromagnetic waves. Further, a description is given of the case where the vehicle-mounted information processing device is fitted on the back of an instrument panel, but the present invention is also applicable as an antenna for vehicle-mounted information processing devices arranged on the back of various veneer plates within a vehicle.

The above described embodiments are examples, and various modifications can be made without departing from the spirit and scope of the invention.

The disclosure of the following priority application is herein incorporated by reference:

Japanese Patent Application No. 2005-090947 filed Mar. 28, 2005.

What is claimed is:

1. A vehicle-mounted antenna for a vehicle-mounted information processing device, for performing wireless communication within a vehicle between the vehicle-mounted information processing device located at a rear side of a veneer plate and another electronic circuit within the vehicle, with the vehicle-mounted information processing device reading data from a medium inserted via a media insertion opening formed in the veneer plate and executing various processing based on the read-in data, wherein:

the vehicle-mounted antenna is arranged deeper than the media insertion opening, within a region set if the media insertion opening is extended in a direction substantially orthogonal with the veneer plate;

the vehicle-mounted antenna is located on a substrate of the vehicle-mounted information processing device, and the media insertion opening is always open.

2. A vehicle-mounted antenna according to claim 1, wherein:

the vehicle-mounted antenna is provided on an upper side from a media insertion path from the media insertion opening to a media reading position.

3. A vehicle-mounted antenna according to claim 1, wherein:

the vehicle-mounted antenna is located in a position in such a manner that an antenna radiation direction towards a vehicle interior through the media insertion opening does not overlap with the medium when the medium is inserted as far as a media reading position.

4. A vehicle-mounted antenna according to claim 1, wherein:

a periphery of the media insertion opening is constructed from a veneer plate made using a material that blocks electromagnetic waves.

5. A vehicle-mounted antenna according to claim 1, wherein:

the vehicle-mounted antenna is a high-frequency wireless communication antenna.

6. A vehicle mounted antenna according to claim 1, wherein the media insertion opening is provided on a dashboard of the vehicle, and wherein the vehicle-mounted antenna is disposed within the dashboard.

7. A vehicle mounted antenna according to claim 1, wherein the veneer plate corresponds to a portion of a dashboard of the vehicle.

8. A vehicle mounted antenna according to claim 1, wherein the media insertion opening is configured to accept a storage disk for playing by a disk player disposed within a dashboard of the vehicle.

9. A vehicle mounted antenna according to claim 1, wherein the vehicle-mounted antenna is positioned to face a vehicle interior compartment corresponding to a region where a driver of the vehicle is located when operating the vehicle, so as to be positioned to receive wireless signals output by a mobile telephone located within the vehicle interior compartment.

10. A vehicle mounted antenna according to claim 1, wherein the substrate comprises a communications circuit.

11. A vehicle mounted antenna according to claim 10, wherein the communications circuit is mounted on a printed circuit board.

12. A vehicle mounted antenna according to claim 1, wherein, due to the media insertion opening being always open, the antenna always has an antenna radiation pattern that extends outward from the media insertion opening and into a front side of the veneer plate.

* * * * *